US009556883B2

(12) United States Patent
Liang et al.

(10) Patent No.: US 9,556,883 B2
(45) Date of Patent: Jan. 31, 2017

(54) INLET GUIDE VANE DEVICE

(71) Applicant: INDUSTRIAL TECHNOLOGY RESEARCH INSTITUTE, Hsinchu (TW)

(72) Inventors: Kun-Yi Liang, Hsinchu County (TW); Shu-Er Huang, Hsinchu (TW); Chi-Hsing Chen, Hsinchu County (TW); Jenn-Chyi Chung, Changhua County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 493 days.

(21) Appl. No.: 14/173,432

(22) Filed: Feb. 5, 2014

(65) Prior Publication Data

US 2015/0125274 A1 May 7, 2015

(30) Foreign Application Priority Data

Nov. 1, 2013 (TW) ..... 102139791 A

(51) Int. Cl.
*F04D 29/46* (2006.01)
*F04D 17/10* (2006.01)
*F04D 29/42* (2006.01)

(52) U.S. Cl.
CPC ..... *F04D 29/462* (2013.01); *F04D 17/10* (2013.01); *F04D 29/4213* (2013.01); *F05D 2250/51* (2013.01)

(58) Field of Classification Search
CPC ..... F04D 17/10; F04D 29/462
See application file for complete search history.

(56) References Cited

U.S. PATENT DOCUMENTS 3,362,624 A 1/1968 Endress
3,538,579 A 11/1970 Sprenger
(Continued)

FOREIGN PATENT DOCUMENTS

CN 101351647 A 1/2009
CN 201265558 Y 7/2009
(Continued)

OTHER PUBLICATIONS

State Intellectual Property Office of the P. R. C, "Office Action", Jul. 1, 2016, China.
(Continued)

*Primary Examiner* — Craig Kim
*Assistant Examiner* — Jason Davis
(74) *Attorney, Agent, or Firm* — Locke Lord LLP; Tim Tingkang Xia, Esq.

(57) ABSTRACT

An inlet guide vane device having a central axis comprises a first base, a guide sleeve, a blade, a second base, a transmission disk, and an actuator. The first base has at least one first support groove and at least one guide groove. The first support groove extends along a radial direction of the central axis, and the at least one guide groove is located in the first support groove. The guide sleeve is disposed on the first support groove in a manner that the guide sleeve is capable of moving along the radial direction. The guide sleeve has a sliding sleeve, an upper guide post and a lower guide post, the sliding sleeve has a through hole extending along the radial direction. The upper guide post and the lower guide post pass through the sliding groove, and the lower guide post is movably disposed on the guide groove.

34 Claims, 11 Drawing Sheets

(56) References Cited

U.S. PATENT DOCUMENTS

| | | | | |
|---|---|---|---|---|
| 4,177,007 | A | 12/1979 | Schlangen et al. | |
| 4,299,535 | A | 11/1981 | Brockman et al. | |
| 4,695,220 | A | 9/1987 | Dawson | |
| 4,836,746 | A | 6/1989 | Owsianny et al. | |
| 4,969,798 | A | 11/1990 | Sakai et al. | |
| 5,049,033 | A | 9/1991 | Corsmeier et al. | |
| 6,039,534 | A * | 3/2000 | Stoner | F01D 17/162 415/150 |
| 6,450,763 | B1 | 9/2002 | Crum et al. | |
| 8,033,785 | B2 | 10/2011 | Thermos et al. | |
| 8,079,808 | B2 * | 12/2011 | Sconfietti | F04D 29/462 415/162 |
| 8,156,757 | B2 | 4/2012 | Doty et al. | |
| 8,181,479 | B2 | 5/2012 | Tsukamoto et al. | |
| 8,240,983 | B2 | 8/2012 | Suljak, Jr. et al. | |
| 2010/0329898 | A1 | 12/2010 | Dunn et al. | |

FOREIGN PATENT DOCUMENTS

| | | | |
|---|---|---|---|
| CN | 101743379 | A | 6/2010 |
| CN | 201843830 | U | 5/2011 |
| CN | 201865979 | U | 6/2011 |
| CN | 102734224 | A | 10/2012 |
| JP | 2006046220 | | 2/2006 |
| JP | 2010001821 | | 1/2010 |
| JP | 2011056167 | A1 | 5/2011 |
| JP | 2013019304 | | 1/2013 |
| TW | 363111 | | 7/1999 |

OTHER PUBLICATIONS

Cao Shu Liang et al., Design and experiment of inlet guide vane for centrifugal pump, 2010, 1000-1298, S0-0001-05, China Academic Journal Electronic Publishing House.

Armin Zemp et al., Experimental investigation of forced response impeller blade vibration in a centrifugal compressor with variable inlet guide vanes—Part 1: Blade damping, Proceedings of ASME Turbo Expo, 2011, 1369-1380.

L. Zhou et al., Experimental Study on the Influence of Diffuser and Inlet Guide Vane for the Performance of Centrifugal Compressor, Experimental Techniques, 2008, 26-33.

Inlet guide vane for centrifugal compressors, News product and services.

Gui Shaobo et al., Numerical simulation and experiment of inlet guide vane pre-whirl regulation for centrifugal pump, 2009, China Academic Journal Electronic Publishing House.

Jiajian Tan et al., The effects of radial inlet on the performance of variable inlet guide vanes in a centrifugal compressor stage, Proceedings of ASME Turbo Expo, 2010: Power for Land, Sea and Air, 1723-1732.

H. Mohtar et al.,Variable inlet guide vanes in a turbocharger centrifugal compressor: Local and global study, SAE Technical Paper Series, 2008, 2008-01-0301.

Intellectual Property Office, Ministry of Economic Affairs, R. O. C, "Notice of Allowance", Nov. 17, 2015, Taiwan.

* cited by examiner

INLET GUIDE VANE DEVICE

CROSS-REFERENCE TO RELATED APPLICATIONS

This non-provisional application claims priority under 35 U.S.C. §119(a) on Patent Application No(s). 102139791 filed in Taiwan, R.O.C. on Nov. 1, 2013, the entire contents of which are hereby incorporated by reference.

TECHNICAL FIELD

The disclosure relates to an inlet guide vane device.

BACKGROUND

A centrifugal compressor is used for compressing fluid, and it mainly comprises an impeller, a shaft, a cylinder, a diffuser, corners, a reflux, an intake manifold and an exhaust pipe. An inlet guide vane device is employed on the impeller.

When the centrifugal compressor operates, the impeller rotates in a high speed so that the airflow inside thereof rotates accordingly. By the impact of the centrifugal force generated by the rotation of the impeller, the fluid is driven to the diffuser behind. Thus, a vacuum space is formed in the impeller so that the air is sucked in and thrown out thereafter. Since the impeller keeps rotating, the air is continuously sucked in and thrown out and this ensures the continuous flow of the air. Compared to the reciprocating compressor, the advantages of the centrifugal compressor include its compact structure, small size, light weight and continuous and uniform exhaust. Besides, the centrifugal compressor does not require an intermediate tank. As a result, the centrifugal compressor generates less vibration and requires fewer consumables.

The blades of the inlet guide vane device near the impeller and the air let can rotate for modifying the flow of the fluid, or even for closing the channel. However, today's structure for the rotation of the blades is too complicated, thereby resulting in poor efficiency. Consequently, it is important to improve the rotation structure of the blades, in order to control the flow of the fluid effectively.

SUMMARY

An inlet guide vane device having a central axis comprises a first base, a guide sleeve, a blade, a second base, a transmission disk, and an actuator. The first base has at least one first support groove and at least one guide groove. The at least one first support groove extends along a radial direction of the central axis, and the at least one guide groove is located in the first support groove. The guide sleeve is disposed on the first support groove in a manner that the guide sleeve is capable of moving along the radial direction. The guide sleeve has a sliding sleeve, an upper guide post and a lower guide post, the sliding sleeve has a through hole extending along the radial direction. The upper guide post and the lower guide post pass through the sliding groove, and the lower guide post is movably disposed on the guide groove. One end of the blade is connected to a shaft. The outer surface of the shaft has two spiral grooves. The blade is rotatably disposed through the through hole of the guide sleeve. The two spiral grooves match the upper guide post and the lower guide post respectively, and the blade extends from the shaft to the central axis. The second base is disposed on the first base and having an annular groove surrounding the central axis. The blade is between the second base and the first base. The transmission disk is disposed between the annular groove and the guide sleeve. The transmission disk has a guide groove, the distance between one end of the guide groove to the central axis is different from the distance between the other end of the guide groove to the central axis, and the upper guide post is movably disposed on the guide groove. The actuator is connected to the transmission disk for driving the transmission disk to rotate and thus driving the guide sleeve to move back and forth, so that the upper post and the lower post drive the blade to rotate in order to open or close the blade.

Furthermore, an inlet guide vane device having a central axis comprises a first base, a blade, a second base, a transmission disk and an actuator. The first base has at least one first support groove, and the at least one first support groove extends along a radial direction of the central axis. One end of the blade is connected to a shaft. The shaft comprises a helical gear, the shaft is rotatably disposed in the first support groove, and the blade extends from the shaft towards the central axis. The second base is disposed on the first base, wherein the blade is between the first base and the second base, the second base has at least one second support groove, an annular groove surrounding the central axis and a limit groove. The second support groove extends from the radial direction of the central axis, and the shaft is located between the first support groove and the second support groove in a rotatable manner. The transmission disk is disposed between the annular groove and the second base. The transmission disk has an annular oblique teeth part and a limit protrusion. The limit protrusion is in the limit groove, and the annular oblique teeth part engages with the helical gear in a movable manner. The actuator is connected to the transmission disk for driving the transmission disk to rotate and thus driving the guide sleeve to move back and forth, so that the upper post and the lower post drive the blade to rotate in order to open or close the blade.

Moreover, an inlet guide vane device having a central axis comprises a first base, a first guide sleeve, a first blade, a second base, a central base, a first transmission disk, a second guide sleeve, a second blade, a second transmission disk, a rod and an actuator. The first base has at least one first support groove and at least one guide groove. The at least one first support groove extends along a radial direction of the central axis, and the at least one guide groove being located in the first support groove. The first guide sleeve is disposed on the first support groove in a manner that the first guide sleeve is capable of moving along the radial direction. The first guide sleeve has a first sliding sleeve, a first upper guide post and a first lower guide post. The first sliding sleeve has a first through hole extending along the radial direction. The first upper guide post and the first lower guide post pass through the outside of the first sliding sleeve, and the first lower guide post is movably disposed on the first guide groove. One end of the first blade is connected to a first shaft. The outer surface of the first shaft has two first spiral grooves. The first blade is rotatably disposed through the first through hole of the first guide sleeve. The two first spiral grooves match the first upper guide post and the first lower guide post respectively, and the first blade extends from the first shaft to the central axis. The second base has at least one second support groove and at least one second guide groove The second support groove extends along the radial direction, and the second guide groove is located in the second support groove. The central base has a first surface and a second surface opposite to the first surface, a third support groove, a fourth support groove and a first annular groove and a second annular groove both surrounding the central axis. The second base is disposed on the second surface, both the third support groove and the fourth support groove extend along the radial direction of the central axis. The first guide sleeve is disposed between the first support groove and the third support groove in a rotatable manner, and the first annular groove and the second annular groove are located on the first surface and the second surface, respectively. The first transmission disk is disposed between the first annular groove and the first guide sleeve. The first transmission disk has at least one first guide groove, the distance between one end of the first guide groove to the central axis is different from the distance between the other end of the first guide groove to the central axis, and the first upper guide post is movably disposed on the first guide groove. The second guide sleeve is disposed between the second support groove and the fourth support groove in a manner that the second guide sleeve being capable of moving along the radial direction. The second guide sleeve has a second sliding sleeve, a second upper guide post and a second lower guide post, the second sliding sleeve has a second through hole extending along the radial direction, both the second upper guide post and the second lower guide post pass through the second sliding sleeve, and the second lower guide post is movably disposed on the second guide groove. One end of the second blade is connected to a second shaft, the outer surface of the second shaft has two second spiral grooves. The second blade passes through the second through hole of the second guide sleeve in a rotatable manner. The two spiral grooves match the second upper guide post and the second lower guide post, respectively, and the second blade extends from the second shaft to the central axis. The second transmission disk is disposed between the second annular groove and the second guide sleeve. The second transmission disk has at least one second guide groove. One end of the second guide groove to the central axis is different from the distance between the other end of the second guide groove to the central axis, and the second upper guide post is movably disposed on the second guide groove. The opposite ends thereof are respectively fixed to the first transmission disk and the second transmission disk. The actuator is connected to the rod, the first transmission disk or the second transmission disk. The actuator drives the first transmission disk and the second transmission disk to rotate at the same time, for driving the first guide sleeve and the second guide sleeve to move back and forth, in order that the first upper guide post, the first lower guide post, the second upper guide post and the second lower guide post respectively drive the first blade and the second blade to rotate, for opening or closing the first blade and the second blade.

Additionally, an inlet guide vane device having a central axis comprises a first base, a first transmission disk, a second base, a central base, a first blade, a second transmission disk, a second blade, a rod and an actuator. The first base has a first annular grove extending and surrounding the central axis as well as a first support groove extending along a radial direction of the central axis. The first transmission disk is disposed in the first annular groove and has a first annular oblique teeth part. The second base has a second annular grove extending and surrounding the central axis as well as a second support groove extending along a radial direction of the central axis. The central base is disposed between the first base and the second base. The first transmission disk is located between the central base and the first base. The central base has a first surface, a second surface opposite to the first surface, a third support groove located on the first surface and extending along the radial direction of the central axis, and a fourth support groove located on the second surface and extending along the radial direction of the central axis, wherein the first surface faces the first base and the first transmission disk. One end thereof is connected to a first shaft. The first shaft comprises a first helical gear. The first shaft is disposed between the first support groove and the third support groove in a rotatable manner. The first blade extends from the first shaft towards the central axis, and the first annular oblique teeth part engages with the first helical gear in a movable manner. The second transmission disk is disposed in the second annular groove. The second transmission disk has a second annular oblique teeth part facing the second surface. One end of the second blade is connected to a second shaft. The second shaft comprises a second helical gear. The second annular oblique teeth part engages with the second helical gear in a movable manner. The second shaft is disposed between the first support groove and the third support groove in a rotatable manner. The second blade extends from the first shaft towards the central axis. The opposite ends of the rod are respectively fixed to the first transmission disk and the second transmission disk. The actuator is connected to the rod, the first transmission disk or the second transmission disk. The actuator drives the first transmission disk and the second transmission disk to rotate at the same time, for driving the first helical gear and the second helical gear to rotate back and forth, in order to drive the first blade and the second blade to rotate, for opening or closing the first blade and the second blade.

BRIEF DESCRIPTION OF THE DRAWINGS

The present disclosure will become more fully understood from the detailed description given hereinbelow, along with the accompanying drawings which are for illustration only, thus are not limitative of the present disclosure, and wherein.

DETAILED DESCRIPTION

Figure 1:
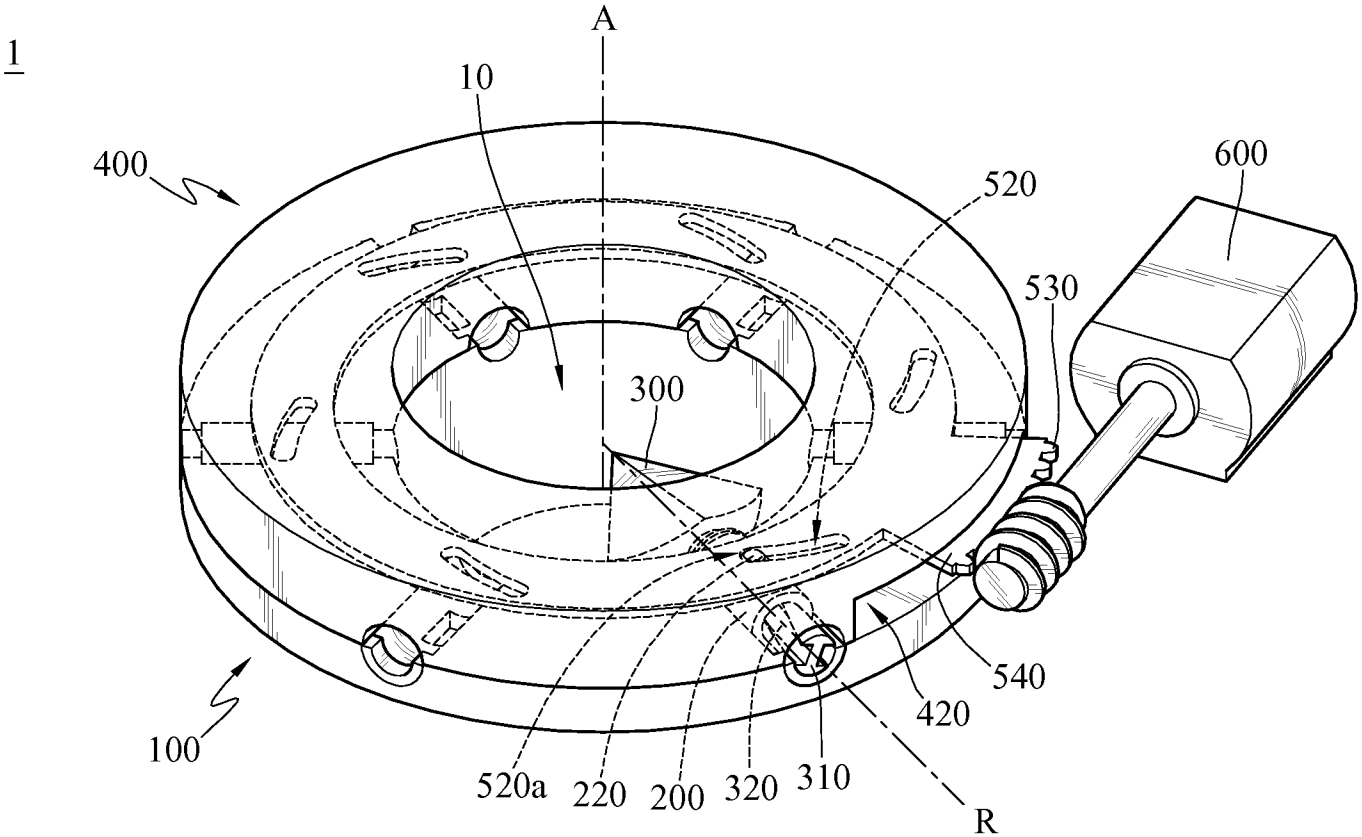
FIG. 1 is a perspective view of an inlet guide vane device according to the first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In this disclosure, the wordings "on", "below", "left", "right", "top", "bottom" and "side" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "bottom" side of other elements would then be oriented on "top" sides of the other elements. The exemplary term "bottom", can therefore, encompasses both an orientation of "bottom" and "top," depending of the particular orientation of the figure. Similarly, if the device in one of the figures is turned over, elements described as "below" or "under" other elements would then be oriented "above" or "on" the other elements. The exemplary terms "below" or "beneath" can, therefore, encompass both an orientation of above and below.

In this disclosure, the same reference numbers for the same components mean that these components are similar in their structures and perform the same functions. By comparison, different reference numbers for the same components mean that these components are different in their structures while perform similar functions.

The disclosure provides an inlet guide vane device configured for a centrifugal compressor. The centrifugal compressor is used for attracting a fluid (e.g. air or refrigerant) to the passage thereof. The impeller of the centrifugal compressor rotates for accelerating and throwing out the fluid. The inlet guide vane is disposed on the passage and is used for controlling the opening and closing of the passage, in order to control the flow of the fluid in the passage. Nevertheless, the disclosure is not limited to the above applications. That is, the inlet guide vane device of the disclosure may apply to other fields.

Figure 2:
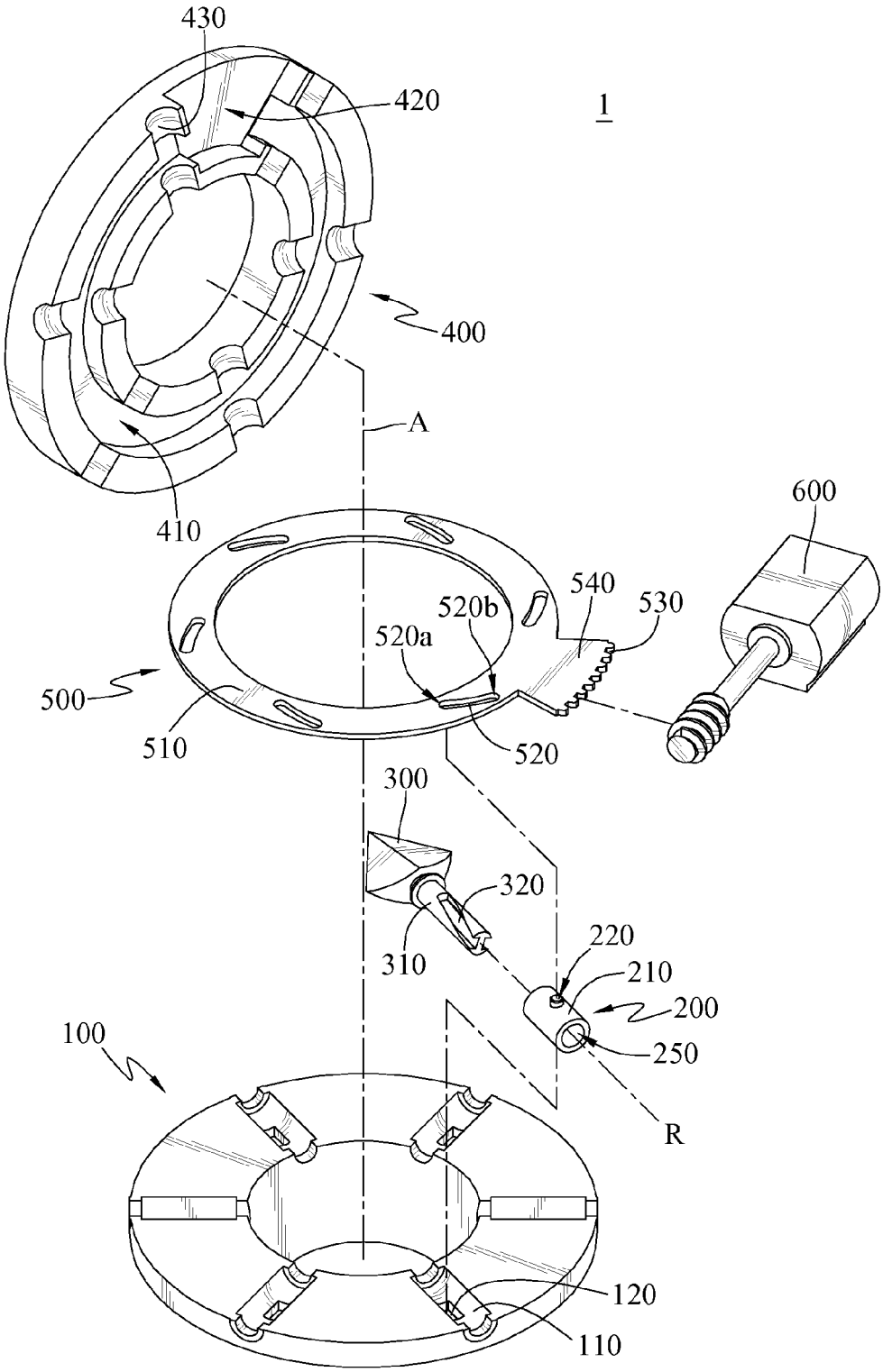
FIG. 2 is an exploded view of the inlet guide vane device according to the first embodiment of the disclosure.

FIG. 1 is a perspective view of an inlet guide vane device according to the first embodiment of the disclosure; and FIG. 2 is an exploded view of the inlet guide vane device according to the first embodiment of the disclosure. As seen in FIG. 1 and FIG. 2, in this embodiment, an inlet guide vane device 1 has a central axis A, and comprises a first base 100, a guide sleeve 200, a blade 300, a second base 400, a transmission disk 500 and an actuator 600. The guide sleeve 200, the blade 300 and the transmission disk 500 are all disposed between the first base 100 and the second base 400. The actuator 600 is connected to the transmission disk 500. The inlet guide vane device 1 further has an air inlet 10 penetrating a central axis A. The air inlet 10 penetrates the first base 100, the second base 400 and the transmission disk 500, while the blade 300 is located in the air inlet 10. A fluid (e.g., air or refrigerant) can pass through the air inlet 10. In this disclosure and the drawings, one set of the guide sleeve 200 and the blade 300 are employed. In other embodiments, however, it is possible to employ multiple sets of the guide sleeve 200 and the blade 300 (e.g., six sets of them), for opening or closing the air inlet 10, and the number of the guide sleeve 200 and the blade 300 is not intended to limit the disclosure.

Now the detail structure of the inlet guide vane device 1 will be illustrated. In this embodiment, the first base 100 has at least one the first support groove 110 and at least one the guide groove 120. The first support groove 110 extends along a radial direction R of the central axis A. The guide groove 120 is located in the first support groove 110 and the guide groove 120 extends along the radial direction R.

Figure 3:
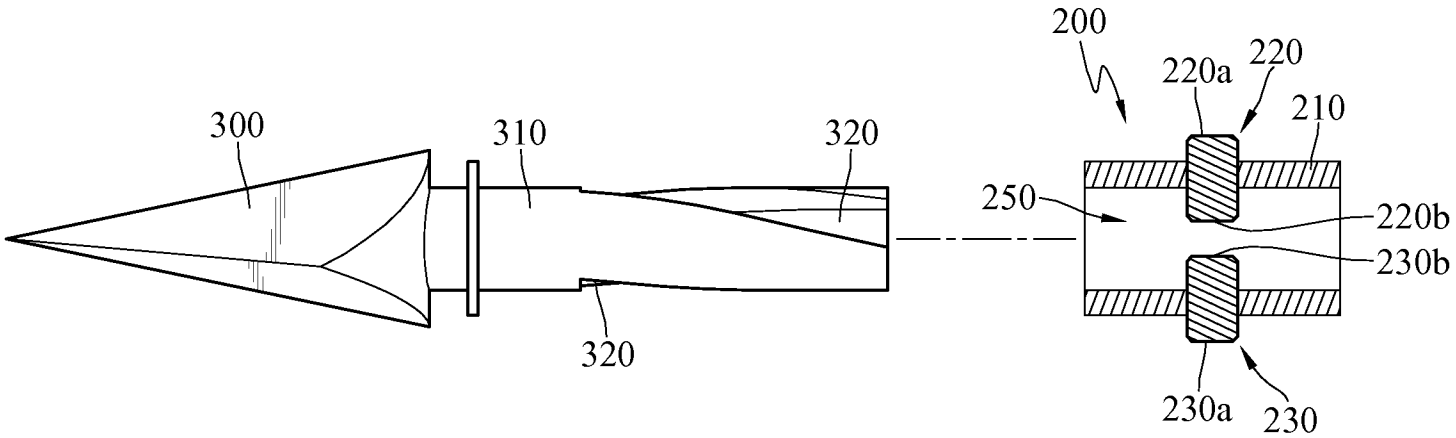
FIG. 3 is a partially sectional view of the blade and the guide sleeve according to the first embodiment of the disclosure.

FIG. 3 is a partially sectional view of the blade and the guide sleeve according to the first embodiment of the disclosure. As seen in FIG. 2 and FIG. 3, the guide sleeve 200 can move along the radial direction R for being disposed in the first support groove 110. In other words, the guide sleeve 200 is movably disposed in the first support groove 110 along the radial direction R. Moreover, the guide sleeve 200 has a sliding sleeve 210, an upper guide post 220 and a lower guide post 230. The sliding sleeve 210 has a through hole 250 extending along the radial direction R. The upper guide post 220 and the lower guide post 230 respectively pass through the sliding sleeve 210. The lower guide post 230 of the guide sleeve 200 is movably disposed on the guide groove 120 of the first base 100. That is, the lower guide post 230 of the guide sleeve 200 can make the guide sleeve 200 move relative to the first base 100 by the guide of the guide groove 120. In this embodiment, the upper guide post 220 has a sliding end 220*a* and a locating end 220*b* that are opposite to each other, while the lower guide post 230 has a guiding end 230*a* and a locating end 230*b* that are opposite to each other. The locating ends 220*b* and 230*b* are located in the through hole 250. The locating end 230*b* is movably disposed in the guide groove 120 of the first base 100. In this embodiment, one end of the blade 300 is connected to a shaft 310. The shaft 310 is disposed on the first support groove 110, and the outer surface of the shaft 310 has two spiral grooves 320. The blade 300 is located between the first base 100 and the second base 400, and the blade 300 passes through the through hole 250 of the guide sleeve 200 in a rotatable manner, with the shaft 310. The shape of spiral grooves 320 respectively match those of the locating end 220*b* and 230*b* of the guide sleeve 200, while the blade 300 extends from the shaft 310 towards the central axis A. Thereby, through the design of the lower guide post 230 matching the locating end 220*b* and the locating end 230*b*, the blade 300 can rotate relative to 20 as the guide sleeve 200 move linearly on the first base 100. In this embodiment, since the shape of the spiral grooves 320 match those of the locating end 220*b* and 230*b*, the blade 300 can be driven to rotate as the guide sleeve 200 moves linearly. Nonetheless, the number of the spiral grooves 320, the locating end 220*b* and 230*b* does not limit the disclosure. In other embodiments, the number of each of them can be one for driving the blade 300 to rotate.

As seen in FIG. 1 and FIG. 2, the second base 400 is disposed on the first base 100 and has an annular groove 410 surrounding the central axis A, and the annular groove 410 faces the first base 100. In this and some other embodiments, the second base 400 further has a limit recess 420 which is exposed and a second support groove 430. The sliding end 220*a* of the upper guide post 220 of the guide sleeve 200 is disposed between the first support groove 110 and the second support groove 430 in a manner that it can move along the radial direction R. However, in other embodiments, the guide sleeve 200 may be disposed on the first support groove 110 for linearly movement. In this embodiment, the transmission disk 500 is disposed between the guide sleeve 200 and the annular groove 410, and the transmission disk 500 has a guide groove 520. The distances between the opposite ends 520*a* and 520*b* of the guide groove 520 to the central axis A are different. The sliding end 220*a* of the upper guide post 220 of the guide sleeve 200 is movably disposed on the guide groove 520. Since the upper guide post 220 is movably disposed on the guide groove 520, the guide groove 520 of the transmission disk 500 drives the upper guide post 220 of the guide sleeve 200 to move as the transmission disk 500 rotates. Since the lower guide post 230 matches the first support groove 110, the guide sleeve 200 can move only on the first support groove 110 along the radial direction R. In this and some other embodiments, the transmission disk 500 further comprises a limit protrusion 540 extending outwardly along the radial direction R and a teeth portion 530. The limit protrusion 540 is limited in the limit recess 420 of the second base 400 in a movable manner. Thereby, when the transmission disk 500 rotates, the limit protrusion 540 rotates and is interfered with the opposite ends of the limit recess 420 so that the transmission disk 500 is unable to rotate and has to stop. In this and some other embodiments, the screw of the actuator 600 engages with the teeth portion 530 of the transmission disk 500, in order to achieve the connection between the actuator 600 and the transmission disk 500. Nevertheless, this design of connection does not limit the disclosure. In other embodiments, the actuator 600 can be connected to the transmission disk 500 by other manners, for driving the transmission disk 500 to move.

The position of the limit recess 420 is not intended to limit the disclosure. In other embodiments, the first base 100 has a limit groove, and the limit protrusion 540 is limited to the limit groove of the first base 100 in a movable manner.

Figure 4:
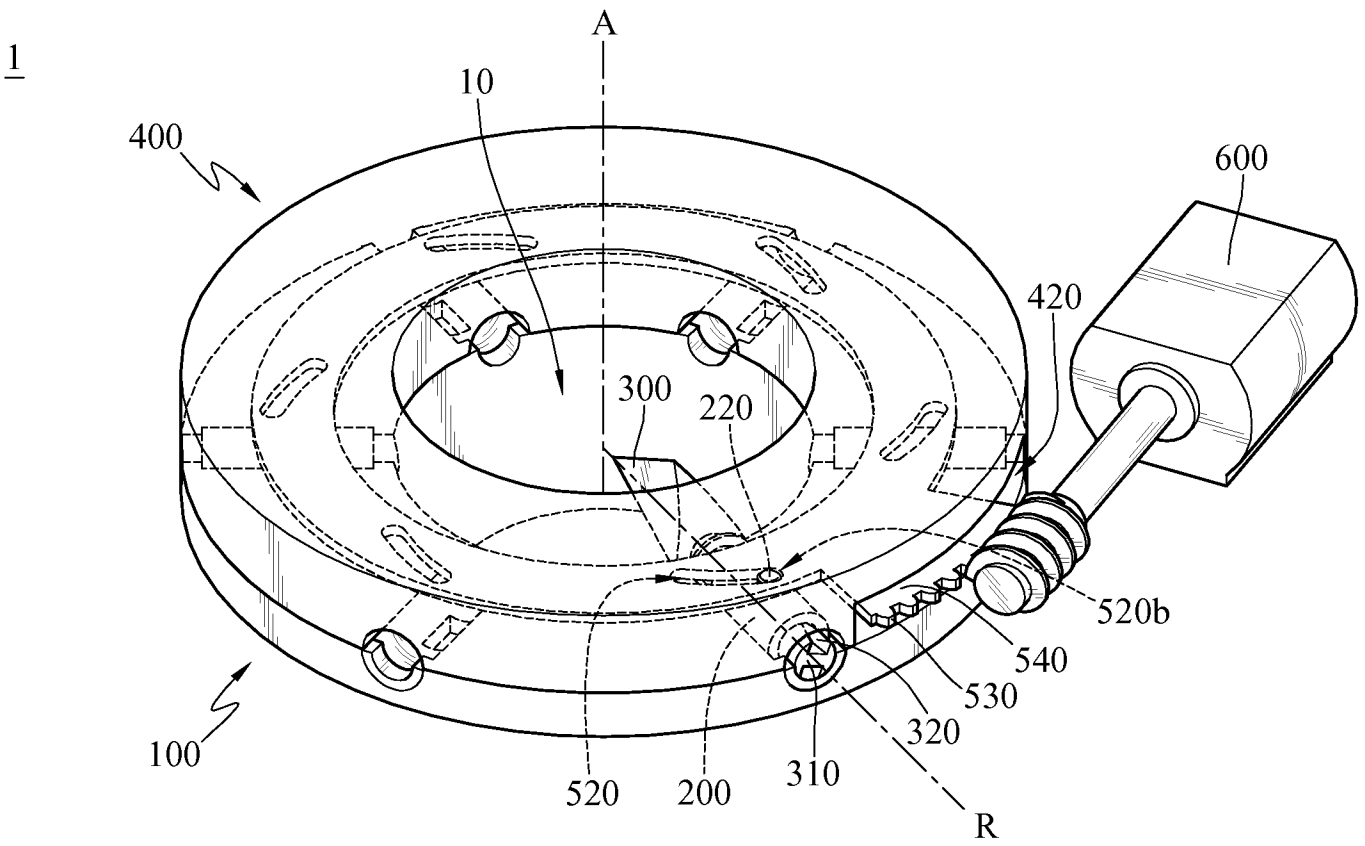
FIG. 4 is a schematic view of the movement of the inlet guide vane device according to the first embodiment of the disclosure.

The movement of the inlet guide vane device 1 will be illustrated in the following paragraphs. As seen in FIG. 1, the blade 300 is currently closed. The limit protrusion 540 is in contact with one end of the limit recess 420, while the upper guide post 220 of the guide sleeve 200 is in contact with the end edge 520*a* of the guide groove 520. FIG. 4 is a schematic view of the movement of the inlet guide vane device according to the first embodiment of the disclosure. As seen in FIG. 2, FIG. 3 and FIG. 4, the actuator 600 is started to drive the transmission disk 500 to rotate, and the guide groove 520 of the transmission disk 500 moves accordingly to make the upper guide post 220 move. The lower guide post 230 is guided by the guide groove 120 so that the upper guide post 220 can move, on the first support groove 110, to the central axis A along the radial direction R. The locating end 220*b* and the locating end 230*b* move along the spiral grooves 320 for driving the blade 300 to rotate. As a result, the blade 300 can be opened. The limit protrusion 540, meanwhile, is in contact with the other end of the limit recess 420, and the upper guide post 220 of the guide sleeve 200 is in contact with the other end the end edge 520*b* of the guide groove 520. In this embodiment, the rotation range of the blade 300 is 90 degrees. Additionally, when it is needed to open the blade 300, the actuator 600 can be driven reversely to rotate the transmission disk 500 reversely, for rotating the blade 300 from the close position to the open position.

In the inlet guide vane device 1, by the rotation of the transmission disk 500 driven by the actuator 600, the transmission disk 500 can lead multiple guide sleeves 200 (only one is shown in the figures, as an example) to move linearly, for leading multiple blades 300 to rotate in situ. Since the actuator 600 drives the transmission disk 500, and the transmission disk 500 can lead multiple blades 300 to move at the same time. In this manner, the actuator 600 can lead all the blades 300 to rotate with less power, thereby improving the stability of the inlet guide vane device 1.

Moreover, by corresponding limit structures of the upper guide post 220 and the guide groove 520, the guide groove 120 and the lower guide post 230, the locating ends 220*b* and 230*b* and the spiral grooves 320, and/or the annular groove 410 and the limit protrusion 540, the inlet guide vane device 1 can control the rotation angle of the blade 300.

Figure 5:
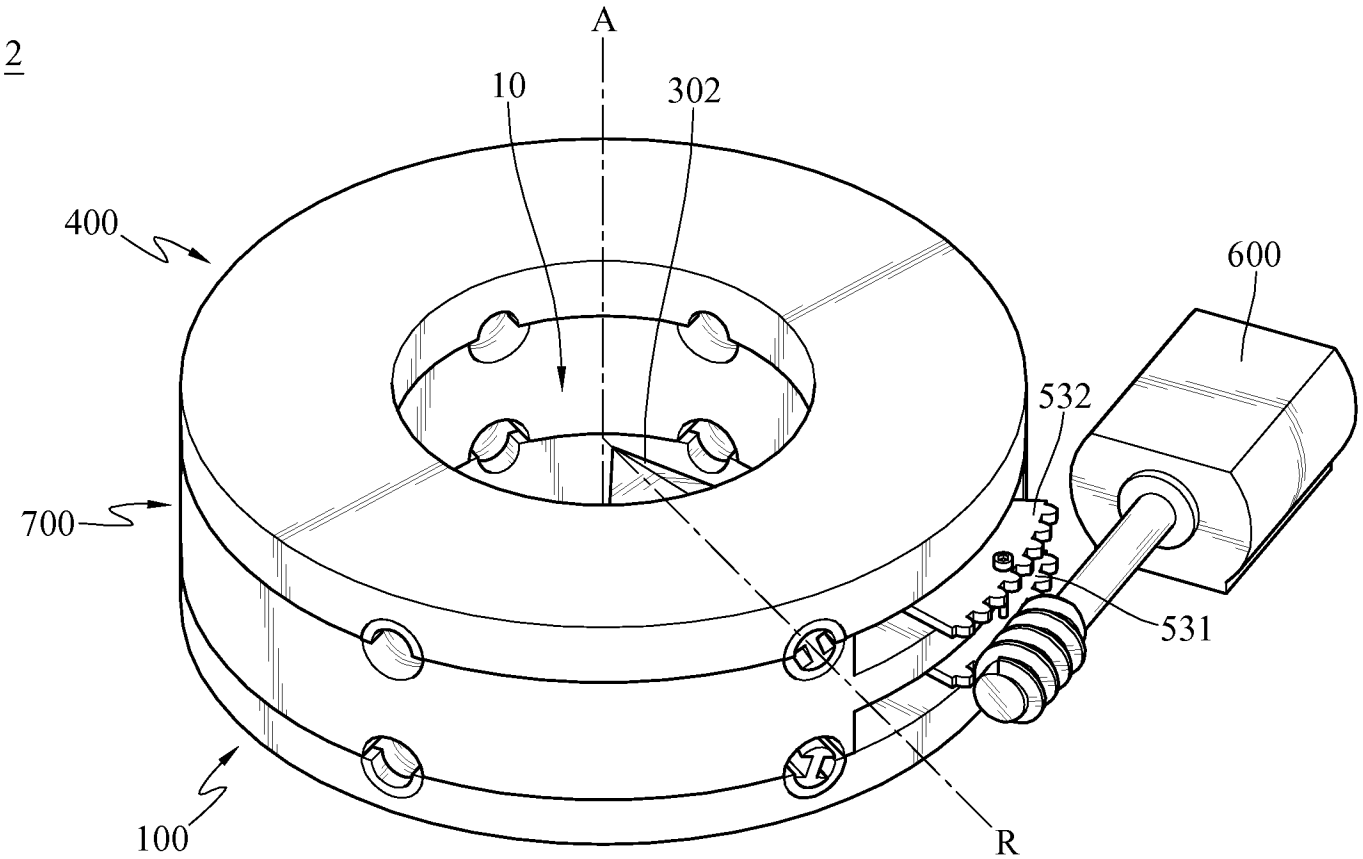
FIG. 5 is a perspective view of an inlet guide vane device according to the second embodiment of the disclosure.
Figure 6:
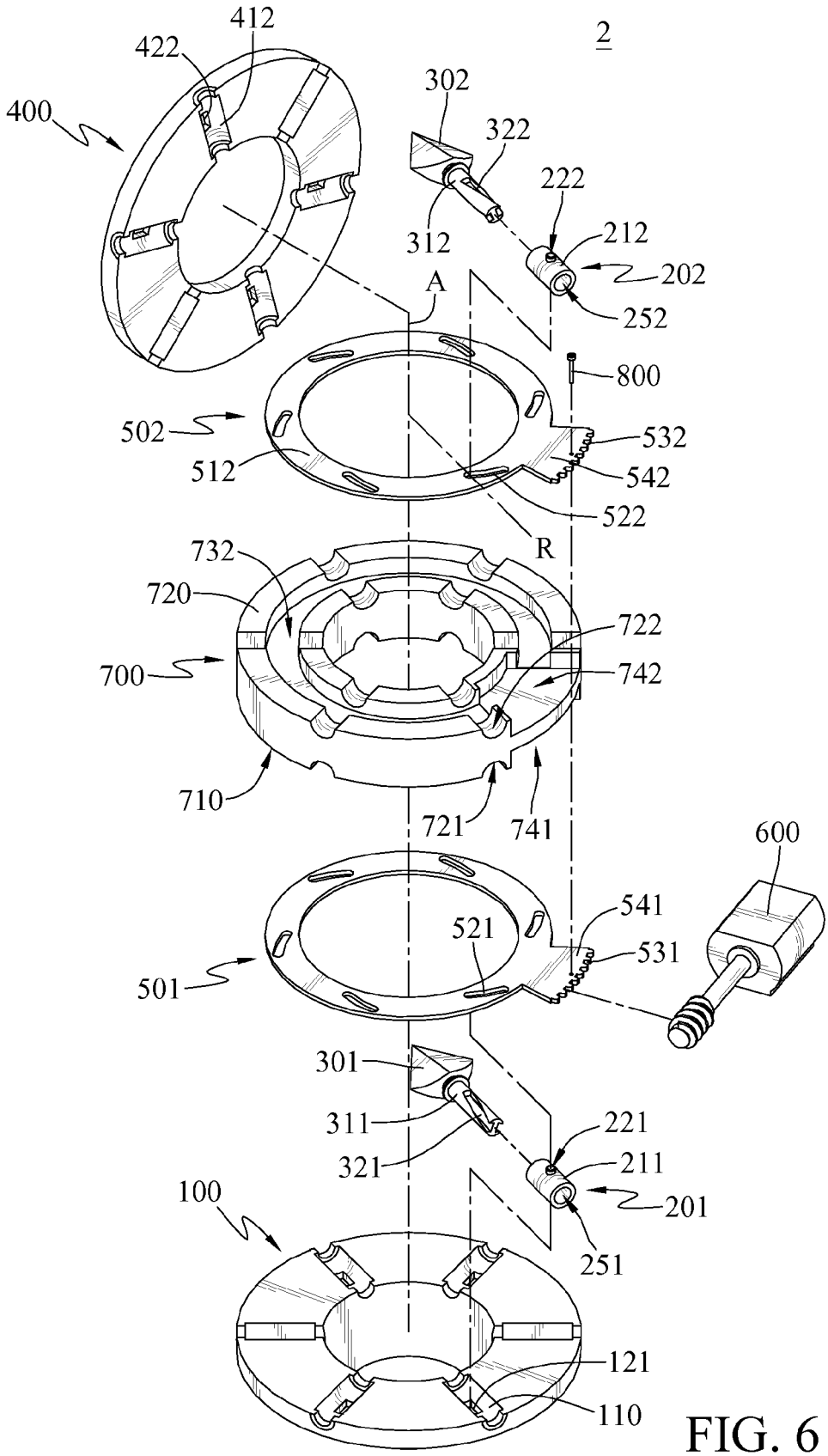
FIG. 6 is an exploded view of the inlet guide vane device according to the second embodiment of the disclosure.

An inlet guide vane device with two transmission disks will be illustrated below. FIG. 5 is a perspective view of an inlet guide vane device according to the second embodiment of the disclosure, while FIG. 6 is an exploded view of the inlet guide vane device according to the second embodiment of the disclosure. As seen in FIG. 5 and FIG. 6, since the structure of the inlet guide vane device 2 of this embodiment is similar to the inlet guide vane device 1, so the same reference numbers represent similar structures. In this embodiment, the inlet guide vane device 2 has a central axis A as well as an air inlet 10, and comprises a first base 100, a first guide sleeve 201, a first blade 301, a central base 700, a first transmission disk 501, a second base 400, a second guide sleeve 202, a second blade 302, a second transmission disk 502, a rod 800 and an actuator 600. The central base 700 is between the first base 100 and the second base 400. In this embodiment, the first guide sleeve 201, the first blade 301 and the first transmission disk 501 are disposed between the first base 100 and the central base 700. The second guide sleeve 202, the second blade 302 and the second transmission disk 502 are disposed between the central base 700 and the second base 400. The air inlet 10 penetrates the first base 100, the first transmission disk 501, the central base 700, the second transmission disk 502 and the second base 400, while the first blade 301 and the second blade 302 are located in the air inlet 10.

The following content is the illustration of the detailed structure of the inlet guide vane device 2. In this embodiment, the first base 100 has at least one the first support groove 110 and at least one the first guide groove 121. The first support groove 110 extends along a radial direction R of the central axis A, while the first guide groove 121 also extends along the radial direction R of the central axis A. The first guide sleeve 201 is disposed on the first support groove 110 in a manner that it can move along the radial direction R. The first guide sleeve 201 has a first sliding sleeve 211, a first upper guide post 221 and a first lower guide post. The first upper guide post 221 has a first through hole 251 extending along the radial direction R. The first upper guide post 221 and the first lower guide post pass through the first sliding sleeve 211, respectively, and the lower guide post is movably disposed on the first guide groove 121. In this embodiment, the structures of the first sliding sleeve 211 of the first guide sleeve 201, the first upper guide post 221 and the first lower guide post are similar to those of the sliding sleeve 210 of the guide sleeve 200, the upper guide post 220 and the lower guide post 230 in the previous embodiment, so these structures will not be explained again. One end of the first blade 301 is connected to a first shaft 311, and the outer surface of the first shaft 311 has two first spiral grooves 321. The first blade 301 pass through the first through hole 251 of the first guide sleeve 201 in a rotatable manner. The first spiral groove 321 matches the first upper guide post 221 and the first lower guide post, while the first blade 301 extends from the first shaft 311 towards the central axis A.

In this embodiment, the central base 700 has a first surface 710 and a second surface 720 that are opposite to each other, a third support groove 721, a fourth support groove 722, and a first annular groove and a second annular groove 732 which both surround the central axis A. The third support groove 721 and the first annular groove are located on the first surface 710, while the fourth support groove 722 and 723 are on the second surface 720. The third support groove 721 and the fourth support groove 722 extend along the radial direction R of the central axis A, and the first guide sleeve 201 is disposed between the first support groove 110 and the third support groove 721 in a rotatable manner. The structures of the first annular groove and the second annular groove 732 are similar to each other and are disposed on the first surface 710 and the second surface 720, respectively. In this and some other embodiments, the central base 700 further has a first limit recess 741 and a second limit recess 742 which are both exposed and are located on the first surface 710 and the second surface 720, respectively. However, the positions of the first limit recess 741 and the second limit recess 742 do not limit thereto. In other embodiments, the first limit groove and the second limit recess are located on the first base 100 and the second base 400, respectively.

In this embodiment, the first transmission disk 501 is disposed between the first annular groove and the first guide sleeve 201. The first transmission disk 501 has at least one the first guide groove 521. The minimum distances between the opposite ends of the first guide groove 521 and the central axis A are different. The first upper guide post 221 is movably disposed on the first guide groove 521. In this and some other embodiments, the first transmission disk 501 further comprises a first teeth portion 531 and a first limit protrusion 541. The first teeth portion 531 is located on the first limit protrusion 541, while the first limit protrusion 541 is disposed in the first limit recess 741. The second base 400 is disposed on the second surface 720 of the central base 700 and has at least one the second support groove 412 and at least one the second guide groove 422. The second support groove 412 extends along the radial direction R and faces the central base 700. The second guide groove 422 is disposed in the second support groove 412 and extends along the radial direction R. The second guide sleeve 202 is disposed between the fourth support groove 722 and the second support groove 412 in a manner that the second guide sleeve 202 is able to move along the radial direction R. The second guide sleeve 202 has a second sliding sleeve 212, a second upper guide post 222 and a second lower guide post. The second sliding sleeve 212 has a second through hole 252. The second upper guide post 222 and the second lower guide post respectively pass through the second sliding sleeve 212. The second lower guide post is movably disposed on the second guide groove 422. The structures of the second sliding sleeve 212 of the second guide sleeve 202, the second upper guide post 222 and the second lower guide post are similar to the sliding sleeve 210, the upper guide post 220, and the lower guide post 230 of the previous embodiment, so these will not be explained again. In this embodiment, one end of the second blade 302 is connected to a second shaft 312, and the outer surface of the second shaft 312 has two second spiral grooves 321. The second blade 302 passes through the second through hole 252 of the second guide sleeve 202 in a rotatable manner. The two second spiral grooves 321 match the first sliding sleeve 211, the first lower guide post, the second upper guide post 222 and the second lower guide post respectively, and the second blade 302 extends from the second shaft 312 towards the central axis A.

In this embodiment, the second transmission disk 502 is disposed between the second annular groove 732 and the second guide sleeve 202. The second transmission disk 502 has at least one the second guide groove 522. The distances between the opposite ends of the second guide groove 522 and the central axis A are different from each other. The second upper guide post 222 is movably disposed on the second guide groove 522. In this and some other embodiments, the second transmission disk 502 further comprises a second teeth portion 532 and a second limit protrusion 542. The second teeth portion 532 is located on the second limit protrusion 542, and the second limit protrusion 542 is disposed in the second limit recess 742. The opposite ends of the rod 800 are fixed to the first transmission disk 501 and the second transmission disk 502 respectively. In this embodiment, the actuator 600 is connected to the first transmission disk 501. In this embodiment, the actuator 600 engages with the first teeth portion 531 of the first transmission disk 501. In other embodiments, the actuator 600 may be connected to the rod 800 or the second transmission disk 502 for making both the first transmission disk 501 and the second transmission disk 502 rotate. In this manner, the actuator 600 drives the first transmission disk 501 and the second transmission disk 502 to rotate at the same time for making both the first guide sleeve 201 and the second guide sleeve 202 move back and forth. This makes the first upper guide post 221, the first lower guide post, the second upper guide post 222 and the second lower guide post drive the first blade 301 and the second blade 302 to rotate, thereby opening or closing the first blade 301 and the second blade 302. In this embodiment, The rotation angle ranges of the first blade 301 and the second blade 302 are 90 degrees. Thereby, actuator 600 can drive the first blade 301 and the second blade 302 to rotate and therefore can open or close them.

Nonetheless, in other embodiments, when the first limit groove and the second limit recess are located on the first base 100 and the second base 400 respectively, the first limit protrusion 541 and the second limit protrusion 542 can be disposed on the first limit groove and the second limit recess, for limiting the movement of the first transmission disk 501 of the first base 100 and the second transmission disk 502 of the second base 400. Thereby, the rotation angles of the first blade 301 and the second blade 302 can be adjusted.

Figure 7:
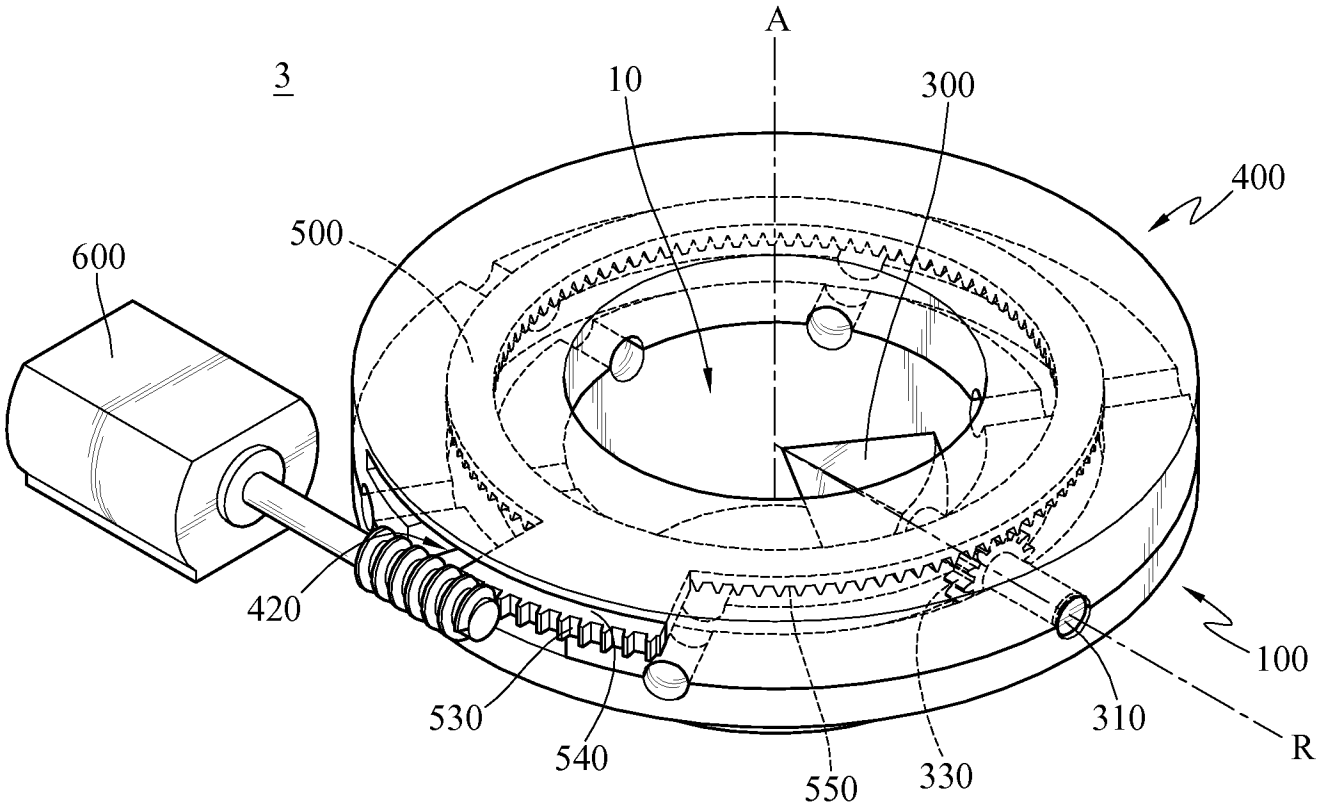
FIG. 7 is a perspective view of an inlet guide vane device according to the third embodiment of the disclosure.
Figure 8:
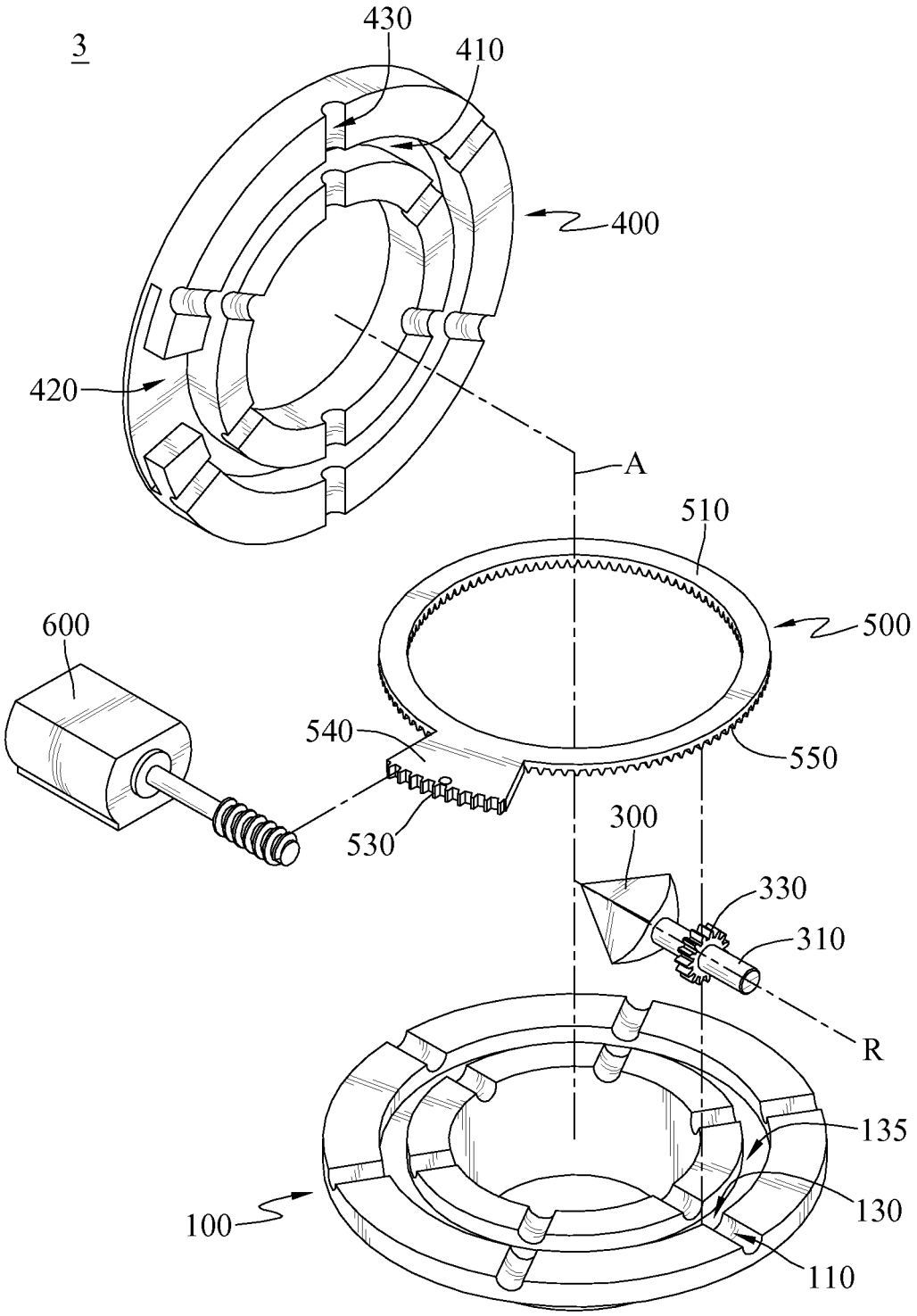
FIG. 8 is an exploded view of the inlet guide vane device according to the third embodiment of the disclosure.

The structure of the guide sleeve leading the rotation of the blades are explained in the above-mentioned embodiments, Now a structure of a helical gear driving the rotation of the blades will be illustrated. FIG. 7 is a perspective view of an inlet guide vane device according to the third embodiment of the disclosure and FIG. 8 is an exploded view of the inlet guide vane device according to the third embodiment of the disclosure. As seen in FIG. 7 and FIG. 8, in this embodiment, the inlet guide vane device 3 has a central axis A and an air inlet 10. It also comprises a first base 100, 1 the blade 300, a second base 400, a transmission disk 500 and an actuator 600. The blade 300 and the transmission disk 500 are disposed between the first base 100 and the second base 400. The air inlet 10 penetrates the first base 100, the second base 400 and the transmission disk 500, while the blade 300 is located inside the air inlet 10.

The detailed structure of the inlet guide vane device 3 will be illustrated herein. In this embodiment, the first base 100 has at least one the first support groove 110 and at least one the accommodation groove 130. The first support groove 110 extends along a radial direction R of the central axis A, while the accommodation groove 130 penetrates a part of the first support groove 110. One end of the blade 300 is connected to a shaft 310, and the shaft 310 comprises a helical gear 330. The shaft 310 is rotatably disposed in the first support groove 110; while the blade 300 extends from the shaft 310 towards the central axis A. The helical gear 330 is rotatably disposed in the accommodation groove 130. In this disclosure, the blade 300, the shaft 310 and the helical gear 330 can be integrally formed as a single unit. Additionally, in this embodiment, multiple accommodation grooves 130 are connected together, therefore forming an annular accommodating recess 135.

In this embodiment, the second base 400 is disposed on the first base 100 and has at least one the second support groove 430, an annular groove 410 surrounding the central axis A and a limit recess 420 which is exposed outside. The second support groove 430 extends along the radial direction R of the central axis A, and the shaft 310 is rotatably disposed between the first support groove 110 and the second support groove 430. The transmission disk 500 is disposed between the annular groove 410 and the second base 400. The transmission disk 500 comprises a disk body 510, an annular oblique teeth part 550 and a limit protrusion 540. The annular oblique teeth part 550 surrounds the disk body 510 and faces the first base 100, and the transmission disk 500 engages with the helical gear 330 in a movable manner. The limit protrusion 540 is connected to the disk body 510 and extends outwardly but is limited inside the limit recess 420. The actuator 600 is connected to the transmission disk 500. In this embodiment, the transmission disk 500 further has a teeth portion 530, and the actuator 600 engages with the teeth portion 530. However, the connection method of the transmission disk 500 and the actuator 600 is not intended to limit the disclosure.

In other embodiments, the transmission disk 500 further comprises a limit block (not shown in the figures) protruding from the disk body 510, while the second base 400 further comprises a through groove (not shown in the figures) which is located in the limit block. Thereby, the second base 400 can limit the movement of the transmission disk 500.

The movement of the inlet guide vane device 3 is illustrated as follows. As seen in FIG. 7 where the blade of the inlet guide vane device 3 is in an open position, the limit protrusion 540 of the transmission disk 500, meanwhile, is located on one end of the limit recess 420.

Figure 9:
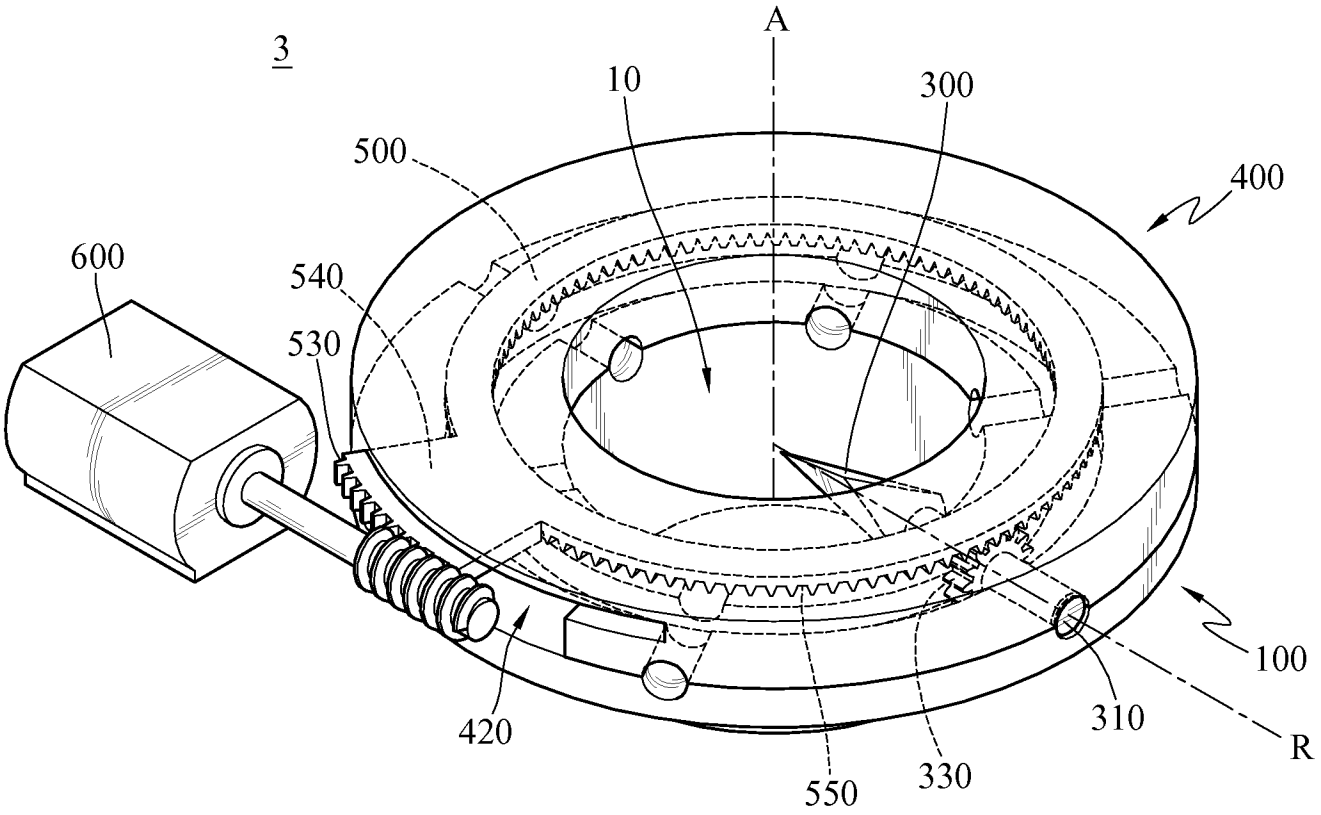
FIG. 9 is a schematic view of the movement of the inlet guide vane device according to the third embodiment of the disclosure.

FIG. 8 is an exploded view of the inlet guide vane device according to the third embodiment of the disclosure and FIG. 9 is a schematic view of the movement of the inlet guide vane device according to the third embodiment of the disclosure. As seen in FIG. 8 and FIG. 9, the actuator 600 drives the transmission disk 500 to rotate and the transmission disk 500 rotates back and forth by the annular oblique teeth part 550 driving the helical gear 330. Thereby, the blade 300 is driven to rotate and thereby opening or closing the blade 300. In this embodiment, the range of rotation angle of the blade 300 is 90 degrees.

In this embodiment, the actuator 600 driving the transmission disk 500 can make multiple blades 300 rotate. Thereby, in this simple mechanism of the inlet guide vane device 3, the actuator 600 can provide less power to all the blade 300 rotate at the same time.

Furthermore, by the limit structure between the limit block of the transmission disk 500 and the through hole of the second base 400 and/or that between the limit protrusion 540 and the limit recess 420, the inlet guide vane device 3 can adjust the rotation angle of the blade 300.

Figure 10:
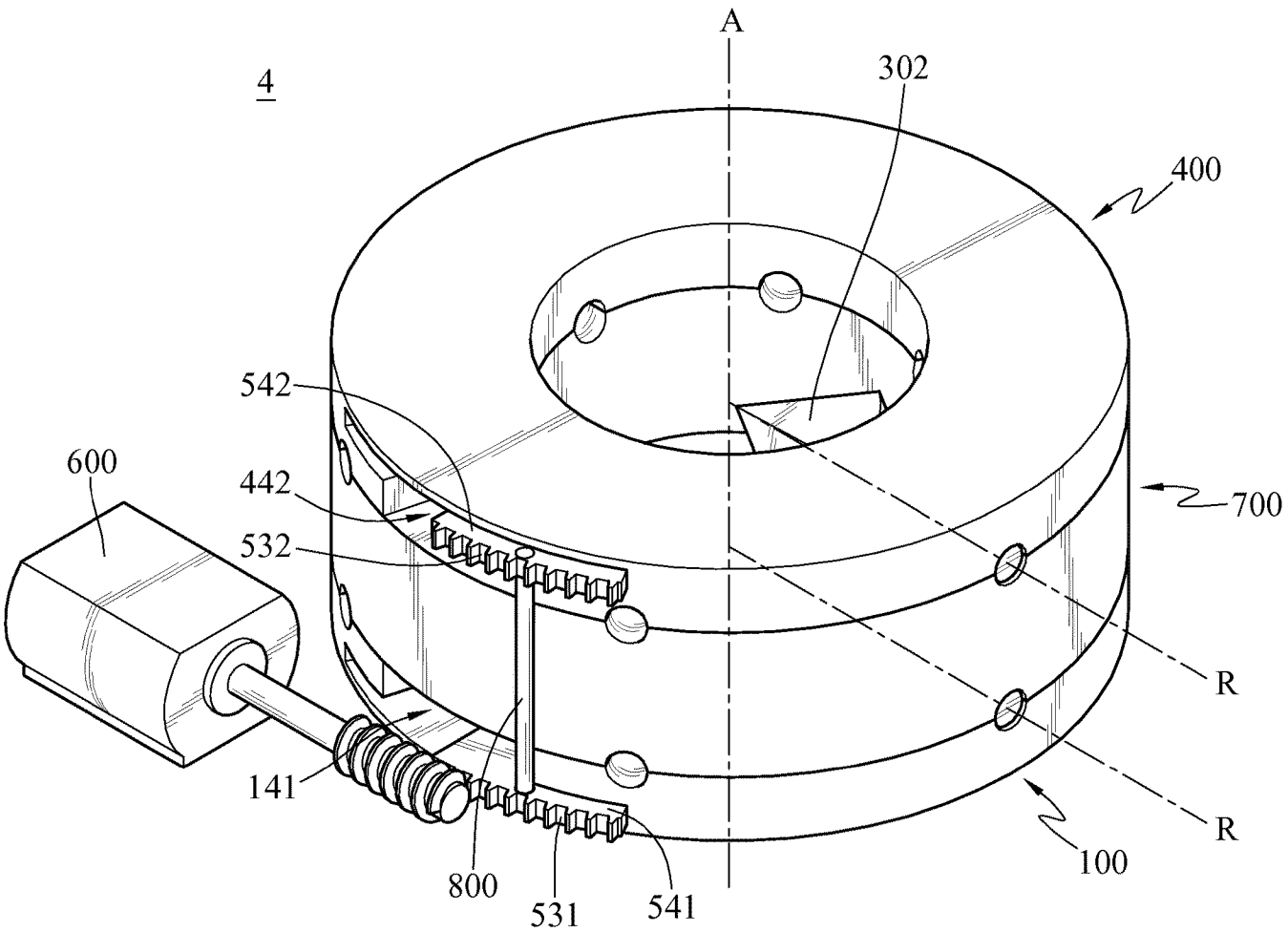
FIG. 10 is a perspective view of an inlet guide vane device according to the fourth embodiment of the disclosure.
Figure 11:
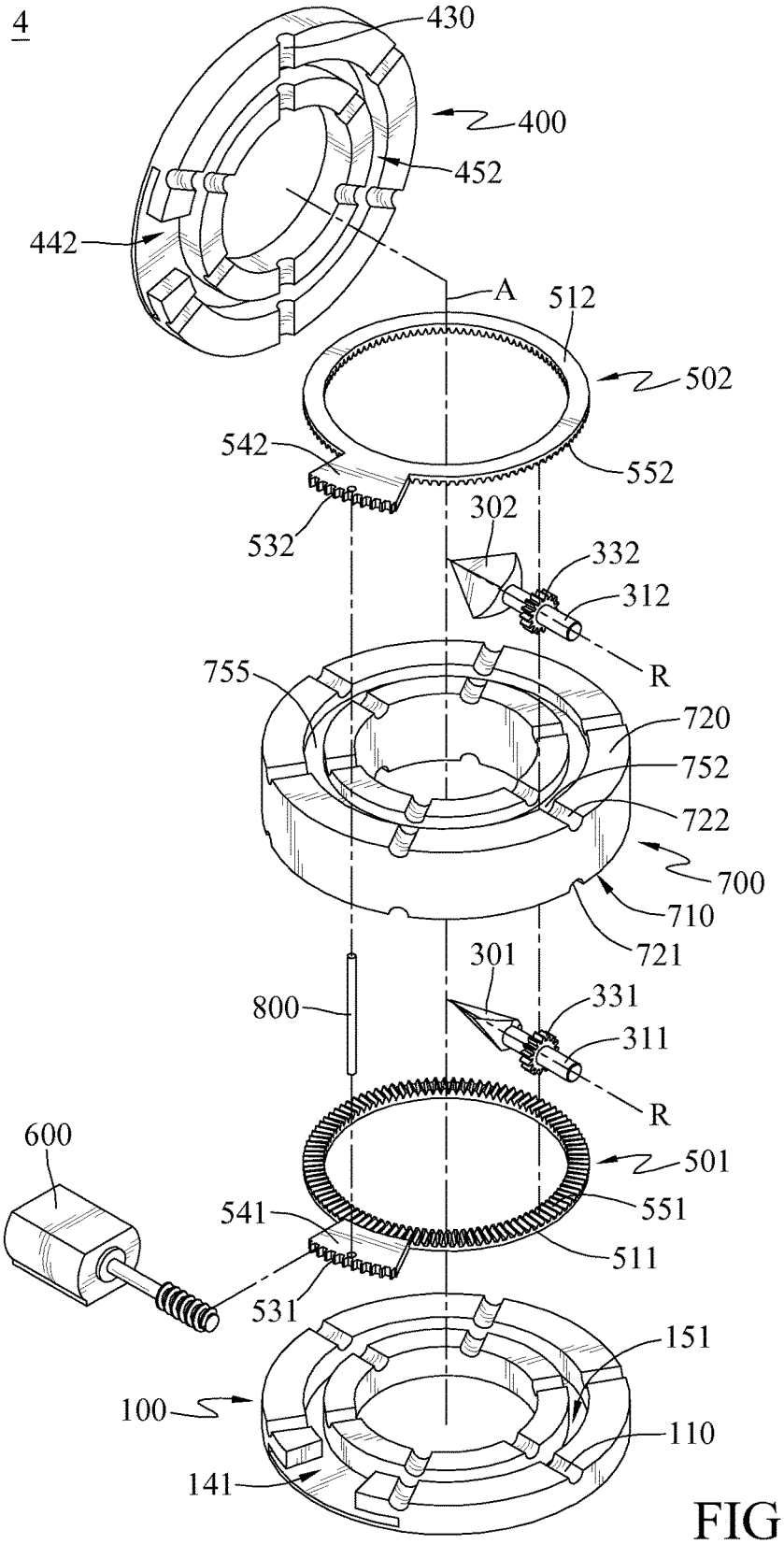
FIG. 11 is an exploded view of the inlet guide vane device according to the fourth embodiment of the disclosure.

Moreover, the helical gear can drive two transmission disks. Referring to FIG. 10 and FIG. 11, FIG. 10 is a perspective view of an inlet guide vane device according to the fourth embodiment of the disclosure, while FIG. 11 is an exploded view of the inlet guide vane device according to the fourth embodiment of the disclosure. In this embodiment, the inlet guide vane device 4 has a central axis A and a air inlet 10. It also comprises a first base 100, a first transmission disk 501, a central base 700, a first blade 301, a second base 400, a second transmission disk 502, a second blade 302, a rod 800 and an actuator 600. The central base 700 is between the first base 100 and the second base 400. Moreover, the first transmission disk 501 and the first blade 301 are disposed between the first base 100 and the central base 700, while the second transmission disk 502 and the second blade 302 are disposed between the central base 700 and the second base 400. The air inlet 10 penetrating the first base 100, the first transmission disk 501, the central base 700, the second transmission disk 502 and the second base 400, and the first blade 301 and the second blade 302 are located inside the air inlet 10.

In this embodiment, the first base 100 has a first annular groove 151 surrounding the central axis A and a first limit recess 141 which is exposed outside. In this and some other embodiments, the first base 100 further has a first support groove 110 extending along the radial direction R. The first transmission disk 501 is disposed inside the first annular groove 151 and comprises a first disk body 511, a first teeth portion 531, a first annular oblique teeth part 551 and a first limit protrusion 541. The first teeth portion 531 is disposed on the first limit protrusion 541, the first annular oblique teeth part 551 faces the central base 700 and is disposed on the first disk body 511 and surrounds the first disk body 511. The first limit protrusion 541 is connected to the first disk body 511 and is inside the first limit recess 141. The central base 700 is disposed on the first base 100 and has a first surface 710, a second surface 720 opposite to the first surface 710, a third support groove 721 which is on the first surface 710 and surrounds the central axis A and a fourth support groove 722 which is on the second surface 720 and surrounds the central axis A. The first surface 710 faces the first base 100 and the first transmission disk 501. One end of the first blade 301 is connected to a first shaft 311. In this embodiment, the central base 700 further has multiple accommodating recesses 752 located on the first surface 710 and the second surface 720 and respectively penetrates the third support groove 721 and the fourth support groove 722. In this embodiment, the accommodating recesses 752 on the second surface 720 can be connected together and form a second annular accommodating groove 755. The structure of the first annular accommodating groove is similar to that of the second annular accommodating groove 755, and the first transmission disk 501 and the second transmission disk 502 respectively correspond to the first annular accommodating recess and the second annular accommodating groove 755.

The first shaft 311 comprises a first helical gear 331. The first shaft 311 is rotatably disposed between the third support groove 721 of the central base 700 and the first support groove 110 of the first base 100. The first blade 301 extends from the first shaft 311 towards the central axis A. The first annular oblique teeth part 551 of the first transmission disk 501 engages with the first helical gear 331 in a movable manner. The first helical gear 331 is also rotatably disposed in the first annular accommodating recess.

In this embodiment, the second base 400 is disposed on the second surface 720 of the central base 700 and has a second annular groove 452 surrounding the central axis A, a second support groove 430 and a second limit recess 442 surrounding the central axis A. The second support groove 430 extends along the radial direction. The second transmission disk 502 is disposed in the second annular groove 452 and comprises a second disk body 512, a second teeth portion 532, a second annular oblique teeth part 552 and a second limit protrusion 542. The second annular oblique teeth part 552 surrounds the second disk body 512 and faces the second surface 720 of the guide sleeve 200. The second limit protrusion 542 is connected to the second disk body 512 and extends outwardly, while the second teeth portion 532 is disposed on the first limit protrusion 541. Thereby, the second limit recess 442 can limit the movement of the second limit protrusion 542. One end of the second blade 302 is connected a second shaft 312. The second shaft 312 comprises a second helical gear 332 rotatably disposed on the second annular accommodating groove 755. The second annular oblique teeth part 552 engages with the second helical gear 332 in a movable manner. The second shaft 312 is disposed between the fourth support groove 722 and the second support groove 430 in a rotatable manner. The second blade 302 extends from the second shaft 312 towards the central axis A, and the second helical gear 332 is rotatably disposed on the second annular accommodating groove 755.

Nevertheless, the positions of the first limit recess 141 and the second limit recess 442 are not limited thereto. In other embodiments, the first limit groove and the second limit recess are located on the first surface 710 and the second surface 720 of the central base 700, respectively. The first limit protrusion 541 and the second limit protrusion 542 can be disposed on the first limit groove of the first surface 710 and the second limit recess of the second surface 720 for providing the limit functions of the first transmission disk 501 and the second transmission disk 502.

The opposite two ends of the rod 800 are fixed to the first transmission disk 501 and the second transmission disk 502 respectively. When the rod 800 is moved by an external force, the first transmission disk 501 and the second transmission disk 502 can move at the same time. Furthermore, when the first transmission disk 501 or the second transmission disk 502 is moved by an external force, the rod 800 can drive the second transmission disk 502 and the second transmission disk 502 to move. In this embodiment, the actuator 600 is connected to the first teeth portion 531 of the first transmission disk 501, but this is not intended to limit the disclosure. In other embodiments, the actuator 600 can be directly connected to the rod 800 or the second transmission disk 502. In this manner, in this embodiment, the actuator 600 drive the first teeth portion 531 engaged thereof to drive the first transmission disk 501 and the second transmission disk 502 to rotate at the same time. Then, the first helical gear 331 and the second helical gear 332 are driven to move back and forth, for making the first blade 301 and the second blade 302 rotate at the same time, thereby opening or closing the first blade 301 and the second blade 302. In this embodiment, the ranges of the rotation angle of the first blade 301 and the second blade 302 are 90 degrees.

To sum up, in the inlet guide vane device set forth above, actuator drives the transmission disk to rotate, thereby driving the guide sleeve move linearly on the support groove or driving the helical gear to rotate. Thereby, the engaged shaft is driven to rotate for opening or closing all of the blades. Via the guide sleeve or the helical gear, the transmission disk of the disclosure can drive all of the corresponding blades to rotate at the same time, and this simplifies the structure of the inlet guide vane device. Moreover, the rotational kinetic energy of the transmission disk can be transmitted to each blade evenly. Additionally, in some embodiments, based on the limit structures (or limit method) between the upper guide post of the guide sleeve and the guide grove of the transmission disk or between the limit protrusion and the limit groove of the second base, the blade can be driven to rotate in a certain range, for opening or closing all of the blades.

What is claimed is:

1. An inlet guide vane device having a central axis and comprising:

a first base having at least one first support groove and at least one guide groove, the at least one first support groove extending along a radial direction of the central axis, and the at least one guide groove being located in the first support groove;

a guide sleeve disposed on the at least one first support groove in a manner that the guide sleeve is capable of moving along the radial direction, wherein the guide sleeve has a sliding sleeve, an upper guide post and a lower guide post, the sliding sleeve has a through hole extending along the radial direction, the upper guide post and the lower guide post pass through the sliding groove, and the lower guide post is movably disposed on the guide groove;

a blade, wherein one end of the blade is connected to a shaft, the outer surface of the shaft has two spiral grooves, the blade is rotatably disposed through the through hole of the guide sleeve, the two spiral grooves match the upper guide post and the lower guide post respectively, and the blade extends from the shaft to the central axis;

a second base disposed on the first base and having an annular groove surrounding the central axis, wherein the blade is between the second base and the first base;

a transmission disk disposed between the annular groove and the guide sleeve, wherein the transmission disk has a guide groove, the distance between one end of the guide groove to the central axis is different from the distance between the other end of the guide groove to the central axis, and the upper guide post is movably disposed on the guide groove; and an actuator connected to the transmission disk for driving the transmission disk to rotate and thus driving the guide sleeve to move back and forth, so that the upper post and the lower post drive the blade to rotate in order to open or close the blade.

2. The inlet guide van edevice according to claim 1, wherein a rotation angle of the blade is in a 90-degree range.

3. The inlet guide vane device according to claim 1, wherein the transmission disk comprises a teeth portion with which the actuator engages.

4. The inlet guide vane device according to claim 1, wherein the second base has a limit groove, and the transmission disk comprises a limit protrusion for being limited in the limit groove of the second base in a movable manner.

5. The inlet guide vane device according to claim 1, wherein the guide groove extends along the radial direction.

6. The inlet guide vane device according to claim 1, further comprising an air inlet penetrating the first base, the second base and the transmission disk, and the blade being inside the air inlet.

7. An inlet guide vane device having a central axis and comprising:

a first base having at least one first support groove, and the at least one first support groove extending along a radial direction of the central axis;

a blade, wherein one end of the blade is connected to a shaft, the shaft comprises a helical gear, the shaft is rotatably disposed in the at least one first support groove, and the blade extends from the shaft towards the central axis;

a second base disposed on the first base, wherein the blade is between the first base and the second base, the second base has at least one second support groove, an annular groove surrounding the central axis and a limit groove, wherein the second support groove extends from the radial direction of the central axis, and the shaft is located between the first support groove and the second support groove in a rotatable manner;

a transmission disk disposed between the annular groove and the second base, wherein the transmission disk has an annular oblique teeth part and a limit protrusion, the limit protrusion is in the limit groove, and the annular oblique teeth part engages with the helical gear in a movable manner; and an actuator connected to the transmission disk for driving the transmission disk to rotate and thus driving the guide sleeve to move back and forth, so that the upper post and the lower post drive the blade to rotate in order to open or close the blade.

8. The inlet guide vane device according to claim 7, wherein the first base has an accommodating recess, and the helical gear is inside the accommodating recess.

9. The inlet guide vane device according to claim 7, wherein the helical gear faces the first base.

10. The inlet guide vane device according to claim 7, wherein a rotation angle of the blade is in a 90-degree range.

11. The inlet guide vane device according to claim 7, wherein the transmission disk further comprises a limit block, the second base further comprises a through groove, the limit block is in the through groove.

12. The inlet guide vane device according to claim 7, wherein the transmission disk has a teeth portion, and the actuator engages with the teeth portion.

13. The inlet guide vane device according to claim 7, further comprising an air inlet penetrating the first base, the second base and the transmission disk, and wherein the blade is inside the air inlet.

14. An inlet guide vane device having a central axis and comprising:

a first base having at least one first support groove and at least one guide groove, the at least one first support groove extending along a radial direction of the central axis, and the at least one guide groove being located in the at least one first support groove;

a first guide sleeve disposed on the at least one first support groove in a manner that the first guide sleeve is capable of moving along the radial direction, wherein the first guide sleeve has a first sliding sleeve, a first upper guide post and a first lower guide post, the first sliding sleeve has a first through hole extending along the radial direction, the first upper guide post and the first lower guide post pass through the outside of the first sliding sleeve, and the first lower guide post is movably disposed on the first guide groove;

a first blade, wherein one end of the first blade is connected to a first shaft, the outer surface of the first shaft has two first spiral grooves, the first blade is rotatably disposed through the first through hole of the first guide sleeve, the two first spiral grooves match the first upper guide post and the first lower guide post respectively, and the first blade extends from the first shaft to the central axis;

a second base having at least one second support groove and at least one second guide groove, wherein the at least one second support groove extends along the radial direction, and the at least one second guide groove is located in the at least one second support groove;

a central base having a first surface and a second surface opposite to the first surface, a third support groove, a fourth support groove and a first annular groove and a second annular groove both surrounding the central axis, wherein the second base is disposed on the second surface, both the third support groove and the fourth support groove extend along the radial direction of the central axis, the first guide sleeve is disposed between the first support groove and the third support groove in a rotatable manner, and the first annular groove and the second annular groove are located on the first surface and the second surface, respectively;

a first transmission disk disposed between the first annular groove and the first guide sleeve, wherein the first transmission disk has at least one first guide groove, the distance between one end of the at least one first guide groove to the central axis is different from the distance between the other end of the at least one first guide groove to the central axis, and the first upper guide post is movably disposed on the at least one first guide groove;

a second guide sleeve disposed between the second support groove and the fourth support groove in a manner that the second guide sleeve being capable of moving along the radial direction, wherein the second guide sleeve has a second sliding sleeve, a second upper guide post and a second lower guide post, the second sliding sleeve has a second through hole extending along the radial direction, both the second upper guide post and the second lower guide post pass through the second sliding sleeve, and the second lower guide post is movably disposed on the second guide groove;

a second blade, wherein one end of the second blade is connected to a second shaft, the outer surface of the second shaft has two second spiral grooves, the second blade passes through the second through hole of the second guide sleeve in a rotatable manner, the two second spiral grooves match the second upper guide post and the second lower guide post, respectively, and the second blade extends from the second shaft to the central axis;

a second transmission disk disposed between the second annular groove and the second guide sleeve, the second transmission disk has at least one second guide groove, one end of the at least one second guide groove to the central axis is different from the distance between the other end of the second guide groove to the central axis, and the second upper guide post is movably disposed on the second guide groove;

a rod, the opposite ends thereof are respectively fixed to the first transmission disk and the second transmission disk; and an actuator connected to the rod, the first transmission disk or the second transmission disk, wherein the actuator drives the first transmission disk and the second transmission disk to rotate at the same time, for driving the first guide sleeve and the second guide sleeve to move back and forth, in order that the first upper guide post, the first lower guide post, the second upper guide post and the second lower guide post respectively drive the first blade and the second blade to rotate, for opening or closing the first blade and the second blade.

15. The inlet guide vaen device according to claim 14, wherein trotation angles of the first blade and the second blade are in a 90-degree range.

16. The inlet guide vane device according to claim 14, wherein the first transmission disk comprises a first teeth portion.

17. The inlet guide vane device according to claim 16, wherein the actuator engages with the first teeth portion.

18. The inlet guide vane device according to claim 14, wherein the central base has a first limit recess, the first transmission disk comprises a first limit protrusion, and the first limit protrusion is disposed in the first limit recess.

19. The inlet guide vane device according to claim 18, wherein the central base has a second limit recess locating on the second surface, the first limit recess is located on the first surface, the second transmission disk has a second limit protrusion, and the second limit protrusion is disposed on the second limit recess.

20. The inlet guide vane device according to claim 14, wherein the first base has a first limit recess, the first transmission disk has a first limit protrusion, and the first limit protrusion is located in the first limit recess.

21. The inlet guide vane device according to claim 20, wherein the second base has a second limit recess, the second transmission disk has a second limit protrusion, and the second limit protrusion is located in the second limit recess.

22. The inlet guide vane device according to claim 14, wherein the first guide groove and the second guide groove extend along the radial direction.

23. The inlet guide vane device according to claim 14, further comprising an air inlet penetrating the first base, the first transmission disk, the central base, the second transmission disk and the second base, and the first blade and the second blade are located in the air inlet.

24. An inlet guide vane device having a central axis and comprising:

a first base having a first annular groove extending and surrounding the central axis as well as a first support groove extending along a radial direction of the central axis;

a first transmission disk being disposed in the first annular groove and having a first annular oblique teeth part;

a second base, having a second annular groove extending and surrounding the central axis as well as a second support groove extending along a radial direction of the central axis;

a central base disposed between the first base and the second base, wherein the first transmission disk is located between the central base and the first base, the central base has a first surface, a second surface opposite to the first surface, a third support groove located on the first surface and extending along the radial direction of the central axis, and a fourth support groove located on the second surface and extending along the radial direction of the central axis, wherein the first surface faces the first base and the first transmission disk;

a first blade, wherein one end thereof is connected to a first shaft, the first shaft comprises a first helical gear, the first shaft is disposed between the first support groove and the third support groove in a rotatable manner, the first blade extends from the first shaft towards the central axis, and the first annular oblique teeth part engages with the first helical gear in a movable manner;

a second transmission disk disposed in the second annular groove, wherein the second transmission disk has a second annular oblique teeth part facing the second surface;

a second blade, wherein one end thereof is connected to a second shaft, the second shaft comprises a second helical gear, the second annular oblique teeth part engages with the second helical gear in a movable manner, the second shaft is disposed between the first support groove and the third support groove in a rotatable manner, the second blade extends from the first shaft towards the central axis;

a rod, the opposite ends thereof are respectively fixed to the first transmission disk and the second transmission disk; and an actuator connected to the rod, the first transmission disk or the second transmission disk, wherein the actuator drives the first transmission disk and the second transmission disk to rotate at the same time, for driving the first helical gear and the second helical gear to rotate back and forth, in order to drive the first blade and the second blade to rotate, for opening or closing the first blade and the second blade.

25. The inlet guide vane device according to claim 24, wherein the first base has a first limit recess, the first transmission disk has a first limit protrusion located in the first limit recess.

26. The inlet guide vane device according to claim 25, wherein the second base has a second limit recess, the second transmission disk has a second limit protrusion located in the second limit recess.

27. The inlet guide vane device according to claim 24, wherein the central base has a first limit recess located on the first surface, while the first transmission disk has a first limit protrusion located in the first limit recess.

28. The inlet guide vane device according to claim 27, wherein the central base has a second limit recess located on the second surface, and the first limit recess is located on the first surface, and the second transmission disk has a second limit protrusion located in the second limit recess.

29. The inlet guide vane device according to claim 24, wherein both the first annular tooth and the second annular tooth face the central base.

30. The inlet guide vane device according to claim 24, wherein rotation angles of the first blade and the second blade are both in a 90-degree range.

31. The inlet guide vane device according to claim 24, wherein the first transmission disk has a first teeth portion, and the rod is connected to the first teeth portion.

32. The inlet guide vane device according to claim 31, wherein the first teeth portion engages with the actuator.

33. The inlet guide vane device according to claim 24, further comprising an air inlet penetrating the first base, the first transmission disk, the central base, the second transmission disk and the second base, and the first blade and the second blade are located in the air inlet.

34. The inlet guide vane device according to claim 24, wherein the central base has a first annular accommodating recess which is located on the first surface and surrounds the central axis, and a second annular accommodating recess which is located on the second surface and surrounds the central axis, while the first helical gear and the second helical gear are respectively disposed in the first annular accommodating recess and the second annular accommodating recess in a rotatable manner.

* * * * *